United States Patent [19]

McCants-Reed

[11] Patent Number: 4,807,304

[45] Date of Patent: Feb. 28, 1989

[54] PANTYHOSE UNDERGARMENT

[76] Inventor: Dorothy McCants-Reed, 13052 Sutton Ave., Cerritos, Calif. 90701

[21] Appl. No.: 114,052

[22] Filed: Oct. 29, 1987

[51] Int. Cl.[4] ..... A41B 9/02

[52] U.S. Cl. ..... 2/405; 2/409; 2/78 B

[58] Field of Search ..... 2/409, 405, 408, 403, 2/78 B, 78 R

[56] References Cited

U.S. PATENT DOCUMENTS

| | | | |
|---|---|---|---|
| 357,127 | 2/1887 | Kneip | 2/409 |
| 369,549 | 9/1887 | Persch | 2/409 X |
| 1,088,338 | 2/1914 | Gibbs | 2/78 B |
| 2,312,025 | 2/1943 | Butler | 2/78 B |
| 3,020,556 | 2/1962 | Isley | 2/409 |
| 3,224,448 | 12/1965 | Diebold | 2/408 |
| 4,301,550 | 11/1981 | Carver | 2/408 |

FOREIGN PATENT DOCUMENTS

| | | | |
|---|---|---|---|
| 1404081 | 8/1975 | United Kingdom | 2/409 |

*Primary Examiner*—H. Hampton Hunter
*Attorney, Agent, or Firm*—Robert J. Schaap

[57] ABSTRACT

A pantyhose undergarment, particularly for men, which permits urination and defecation without the need of lowering the same. The undergarment preferably comprises a fabric torso section which extends about a portion of the torso of the user below the waist. A pair of tubular leg sections extend from the torso section and are adapted to receive the legs of a user. The region of connection of the leg sections and the torso section form a crotch region which connects the front and rear lower portions of the torso section. A first set of flaps are capable of being spread apart to form the first opening in the front portion of the torso section to allow urination without the lowering of the undergarment. A second pair of flaps on the rear portion of the torso section are also capable of being spread apart to form a second opening on the rear portion of the torso section to allow defecation without the lowering of the undergarment.

20 Claims, 2 Drawing Sheets

PANTYHOSE UNDERGARMENT

BACKGROUND OF THE INVENTION

1. Field of the Invention

This invention relates in general to certain new and useful improvements in pantyhose undergarments and more particularly, to pantyhose undergarments which contain openable portions on both the front and rear of a lower torso section to allow urination and defecation without the lowering of the undergarment.

2. Brief Description of the Prior Art

The use of pantyhose undergarments by women has been widespread and available for a long period of time. There has been a recent recognition that pantyhose undergarments could be highly useful for men and boys. This is particularly true in the case of athletes who would find a need for such type of undergarment to insulate them from cold and inclement weather when they are performing on an athletic field.

In addition to athletes, it has been recognized that both men and boys who are engaged in outdoor activity and other sporting activities, have a need for these pantyhose undergarments in order to maintain body heat. However, men and boys are particularly concerned about the appearance of their outer garments, such as slacks and trousers, and would strongly object to the creation of a bulky appearance in their outer garments.

In addition to the foregoing, men are often reluctant to use pantyhose undergarments due to the inconvenience when need for urination or defecation arises. While there have been pantyhose undergarments for women and even, to some extent, for men, which provide an opening in the crotch region in the front portion thereof for purposes of urination, there is no such garment which is readily available and which provides a convenient access opening in the rear portion of the garment for defecation to avoid the need of lowering the pantyhose undergarment.

The prior art has provided various types of combination undergarments, as for example, in the Isley U.S. Pat. No. 3,020,556. This type of combination undergarment does have the provision of an access opening which enables urination without the lowering of the pantyhose undergarment. Other undergarments which have access openings in the front portion thereof to allow urination without lowering of the garment, are taught in U.S. Pat. Nos. 3,398,739 to Marino, 3,777,764 to Herbener, 369,549 to Persch, 2,852,780 to Gold, 4,301,550 to Carver, and 3,953,895 to Lowth.

OBJECTS OF THE INVENTION

It is, therefore, one of the primary objects of the present invention to provide a pantyhose undergarment which permits both urination and defecation without the need of lowering the undergarment.

It is another object of the present invention to provide a pantyhose undergarment of the type stated which includes a torso section and pair of leg sections as well as a pair of front flaps capable of being spread apart to allow an opening in the front portion and a second pair of flaps capable of being spread apart to allow another opening in a rear portion of the pantyhose undergarment.

It is a further object of the present invention to provide a pantyhose undergarment of the type stated which can be constructed with a minimum amount of sewing and a minimum amount of material, but which is still durable in construction.

It is an additional object of the present invention to provide a pantyhose undergarment of the type stated which can be made out of a wide variety of materials which are not bulky and can be worn by men without creating discomfort and without interfering with the appearance of outer garments.

It is another salient object of the present invention to provide a pantyhose undergarment of the type stated which can be made at a relatively low cost and which is highly reliable in use.

With the above and other objects in view, our invention resides in the novel features of form, construction, arrangement and combination of parts presently described and pointed out in the claims.

BRIEF SUMMARY OF THE DISCLOSURE

A pantyhose undergarment for men and boys and which permits urination and defecation without the need of lowering the undergarment. The term "men" will be used in a generic sense to refer to both men and boys. While the pantyhose undergarment of the present invention has been designed for use by men, it should understood that the same garment, with slight modifications, could be used for members of the female gender.

The pantyhose undergarment of the present invention comprises a torso section with is adapted to extend about a portion of the lower torso of the wearer and particularly, beneath the waist of the wearer. A pair of tubular fabric leg sections extend downwardly from the torso section and form a crotch region on the lower portion of the torso section. If desired, the pantyhose may be provided with foot pockets for receiving the feet of the wearer.

In a preferred embodiment, a waistband extends about the upper edge of the torso section to engage and tightly hold the pantyhose undergarment on the wearer. A reinforcing fabric strip extends from the waistband in a front portion of the torso section, through the crotch region, and upwardly toward the waistband in the back portion of the torso section. In a more preferred embodiment, this fabric reinforcing strip extends from the waistband in the front section completely around to the waistband in the back portion of the torso section.

A pair of flaps are formed in the fabric strip in the front portion of the torso section to form an opening in the torso section adjacent the crotch region. This opening allows urination without the lowering of the undergarment. In like manner, a second pair of flaps are located on the fabric strip at the rear portion of the torso section. This second pair of flaps is also capable of being spread apart on the rear portion of the torso section. When the second pair of flaps is spread apart, they form an opening which allows defecation without the lowering of the undergarment. The opening in the rear portion may have a greater overall length than the opening in the front portion.

The openings in the front and rear portions are separated by a portion of the reinforcing fabric strip in the crotch region. Thus, the two openings do not necessarily communicate with one another. This allows for a more durable construction, but still provides the convenience needed by the user of the pantyhose undergarment.

This invention possesses many other advantages and has other purposes which may be made more clearly apparent from a consideration of the forms in which it may be embodied. These forms are shown in the drawings forming a part of and accompanying the present specification. They will now be described in detail for the purposes of illustrating the general principles of the invention, but it is to be understood that such detailed description is not to be taken in a limiting sense.

BRIEF DESCRIPTION OF THE DRAWINGS

Figure 1:
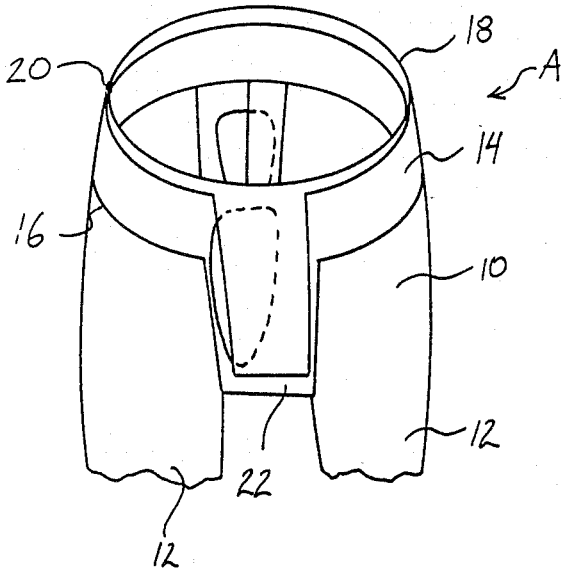
Figure 3:
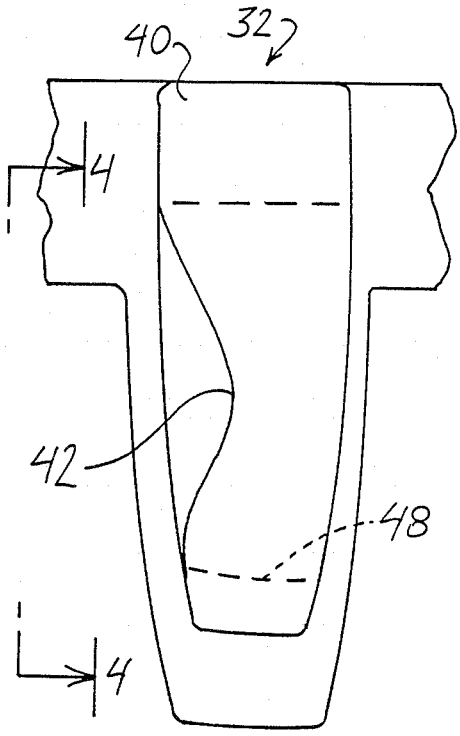
Figure 2:
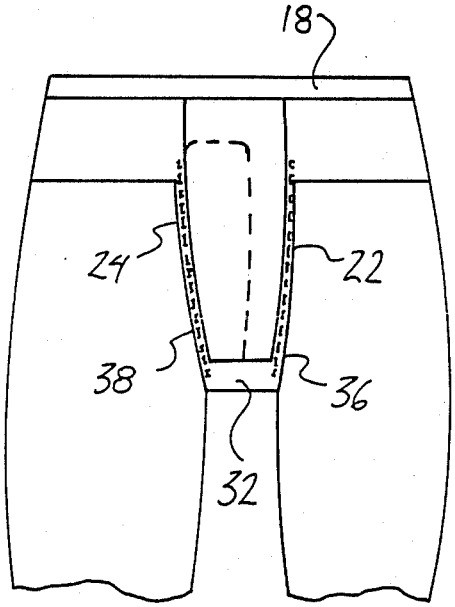
Figure 4:
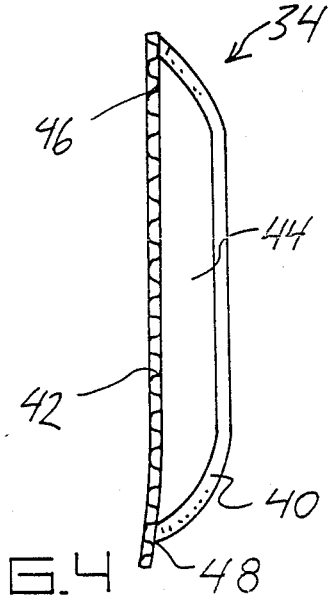
Figure 5:
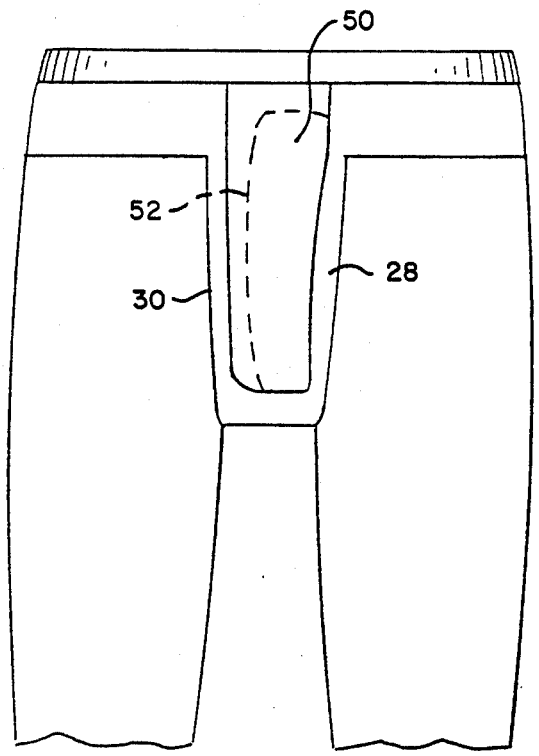
Figure 6:
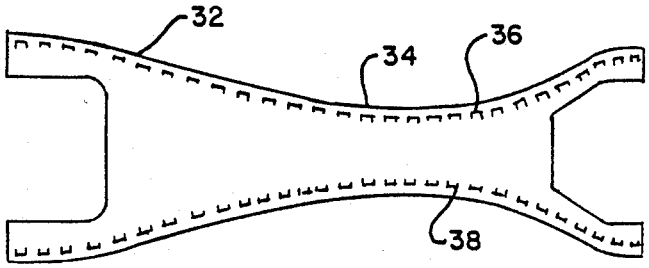

Having thus described the invention in general terms, reference will now be made to the accompanying drawings (two sheets in which:

FIG. 1 is a fragmentary perspective view of a pantyhose undergarment constructed in accordance with and embodying the present invention;

FIG. 2 is a fragmentary front elevational view of the pantyhose undergarment of the present invention;

FIG. 3 is an enlarged fragmentary front elevational view of a reinforcing fabric strip with a flap opening on the front portion thereof;

FIG. 4 is an enlarged vertical sectional view taken substantially along the plane of line 4—4 of FIG. 3;

FIG. 5 is a fragmentary rear elevational view of a portion of the pantyhose undergarment of the present invention; and FIG. 6 is a bottom plan view of the crotch region of the pantyhose undergarment of the present invention.

DETAILED DESCRIPTION OF A PREFERRED EMBODIMENT

Referring now in more detail and by reference characters to the drawings which illustrate a practical embodiment of the present invention, A designates a pantyhose undergarment which generally comprises a torso section 10 and a pair of tubular leg sections 12 which extend downwardly from the torso section 10. The torso section 1 0 is generally of a circular construction so as to receive the lower torso portion of the wearer.

The torso section 10 and the tubular leg sections 12 are preferably formed of a light-weight material which will not create bulkiness or interfere with the drape of an outer garment. However, in many cases, the pantyhose undergarment of the present invention should be constructed of a material which is at least durable in construction and which will provide material for maintaining body heat and therefore provide a degree of warmth, particularly in cold and inclement environments. For example, cotton may be one of the preferred materials used in the construction of the pantyhose undergarment. However, many of the commercially available synthetic fabric materials, such as the rayon materials, Dacron and the like may be used. Moreover, the materials may be down filled or may otherwise contain additional insulating layers, if desired.

The pantyhose undergarment of the present invention also comprises a waistband 14 which is secured to the upper edge of the torso section 10 by a line of stitching 16. In this case, the waistband 14 extends entirely around the torso section. Moreover, the waistband may be provided with an upper elastic band 18, if desired. The elastic band 18 is designed to retentively hold the pantyhose undergarment on the wearer. Moreover, the elastic band may be included within a tubular section formed in the waistband 14, or otherwise sewn thereto by means of a line of stitching 20.

The torso section 10 is open in the front region and a strip is folded over upon the torso section to form a first reinforced area 22. In like manner, on the opposite side thereof, a second strip of the torso section is folded over upon the torso section to form a second reinforced area 24. Referring to FIG. 5, it can be observed that on the rear portion of the torso section, an additional strip of the torso section is folded over upon the rear portion of the torso section to form first reinforced area 28 in the rear torso section. In like manner, an additional strip is folded over on the torso section to form the second reinforced area 30 and which is spaced apart from the reinforced area 28.

Sewn to the reinforced areas 24 and 26, as well as to the waistband 14 is a reinforcing fabric strip 32. In this case, it can be observed that the reinforcing fabric strip extends from the waistband 14 downwardly to the crotch region, and around the crotch region back and upwardly toward the waistband 14 on the rear portion of the torso section 10. Thus, the reinforcing fabric strip 32 is essentially continuous from one side of the waistband 14 to the opposite side of the waistband 14, that is, from the front portion of the waistband to the rear portion of the waistband. In a preferred embodiment, in the manner as illustrated, the reinforcing fabric strip 32 may be integral with the waistband, or otherwise, it may be sewn thereto.

By reference to FIG. 6, which illustrates a portion of the crotch region, it can be observed that the reinforcing fabric strip 32 has an area of reduced width 34 in the crotch region. This is to facilitate the leg sections moving closer together and to prevent any inconvenience to the wearer. Nevertheless, this region of reduced width is still sufficient to provide the desire amount of reinforcing in the crotch region.

The reinforcing fabric strip 32 is secured to the reinforced area 22 in the front portion of the fabric by means of a first line of stitching 36. On the opposite side, the reinforcing strip 32 is secured to the reinforced area 24 by means of a line of stitching 38. Moreover, and by carefully examining FIGS. 5 and 6 as well, it can be observed that the first line of stitching 36 extends through the crotch region and upwardly along the reinforcing fabric strip in the rear portion of the garment. In like manner, the second line of stitching 38 also extends through the crotch region and up along the reinforced area 30 on the rear portion of the torso section. Moreover, it can be observed that the strips of fabric material in the torso section which are folded over upon one another to form the reinforced areas are secured by the same lines of stitching 36 and 38 which are used to secure the reinforcing strip 32. Thus, only a pair of lines of stitching are required to secure the reinforcing strip 32 to the torso section.

The reinforcing strip 32 is more fully illustrated in detail in FIGS. 3 and 4 of the drawings. In this case, it can be observed that the pair of front flaps 40 and 42 are formed on the reinforcing strip. The flap 40 opens on the left-hand side, reference being made to FIG. 3 of the drawings. The flap 42 opens on the right-hand side, reference also being made to FIG. 3 of the drawings. In this way, when the two flaps 40 and 42 are spread apart, they will form a vertically disposed slit or opening 44. This opening 44 is sufficient to allow the user to extend the required body organ therethrough to enable urination.

The flap 42 is actually an additional layer of material which may be secured to the flap 40 by means of pairs of horizontal lines of stitching 46 and 48, in the manner as illustrated in FIGS. 3 and 4 of the drawings. In this case, the second flap 42 would only be secured by means of the horizontal lines of stitching 46 and 48, as well as a portion of the vertical line of stitching 38. However, a portion of the flap 40 would not be secured on its left-hand side by the line of stitching 38. In like manner, a portion of the right-hand margin of the flap 42 would not be secured by the line of stitching 36 on its right-hand side.

The rear portion of the pantyhose undergarment is also provided with a pair of flaps 50 and 52 to provide an access opening much like the access opening 44 in the front portion of the front portion of the torso section. Moreover, the construction of the two flaps on the rear portion of the reinforcing fabric strip would be similar to, if not substantially identical to, the construction of the flaps 40 and 42 which form the access opening 44 on the front portion of the fabric strip. The primary difference in the openings is that the opening on the rear portion of the reinforcing fabric strip would have a longer length than the opening on the front portion of the fabric strip. This is due to the fact that it would facilitate the spreading apart of the flaps 50 and 52 in order to enable defecation without the lowering of the pantyhose undergarment.

By further reference to FIG. 6, it can be observed that the two openings in the front and rear portions of the pantyhose undergarment are separated by the reinforcing fabric strip in the crotch region and particularly, the area of reduced width 34. This construction still provides the desired degree of convenience to the user, but also provides for the necessary amount of reinforcement of the garment.

Thus, there has been illustrated and described a unique and novel pantyhose undergarment for men which permits urination and defecation without the need of lowering the undergarment. The pantyhose undergarment thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention.

Having thus described the invention, what I desire to claim and secure by letters patent is:

1. A pantyhose undergarment for men which permits urination and defecation without need of lowering the undergarment said undergarment comprising:

(a) a fabric torso section adapted to extend about a portion of the torso of the user below the waist, (b) a pair of tubular leg sections extending from the torso section and forming a crotch region on the lower portion of the torso section, (c) a first pair of flaps capable of being spread apart to form a first opening in the front portion of the torso section adjacent the crotch region to allow urination without lowering of the undergarment, and (d) a second pair of flaps capable of being spread apart to form a second opening in the rear portion of the torso section adjacent the crotch region to allow defecation without lowering of the undergarment.

2. The pantyhose undergarment of claim 1 further characterized in that said first opening is spaced from said second opening by a fabric strip in the crotch region.

3. The pantyhose undergarment of claim 1 further characterized in that the first pair of flaps extends from the crotch region upwardly toward an upper waist section on the torso section.

4. The pantyhose undergarment of claim 3 further characterized in that the second pair of flaps extends from the crotch region upwardly toward an upper waist section of the torso section.

5. A pantyhose undergarment comprising:

(a) a fabric torso section adapted to extend about a portion of the lower torso of a wearer, (b) a pair of fabric tubular leg sections extending downwardly from the torso section and forming a crotch region on the lower portion of the torso section, (c) a waistband extending around an upper edge of the torso section, (d) a reinforcing fabric strip extending from the waistband in a front portion of the torso section toward the waistband in the back portion of the torso section and which also extends through the crotch region, (e) means forming a first opening in said front portion of the torso section in proximity to the crotch region, and (f) means forming a second opening in the rear portion of the torso section in proximity to the crotch region.

6. The pantyhose undergarment of claim 5 further characterized in that said openings are generally vertically disposed slits.

7. The pantyhose undergarment of claim 5 further characterized in that the openings are separated from one another by the fabric strip in the crotch region.

8. The pantyhose undergarment of claim 5 further characterized in that the means forming the first opening comprises a first outer flap which extends over a second inner flap and which are capable of being spread apart to form a vertically disposed slit.

9. The pantyhose undergarment of claim 8 further characterized in that the means forming the second opening comprises a first outer flap which extends over a second inner flap and which are capable of being spread apart to form a vertically disposed slit.

10. The pantyhose undergarment of claim 7 further characterized in that the first pair of flaps extend from the crotch region upwardly toward an upper waist section on the torso section.

11. The pantyhose undergarment of claim 10 further characterized in that the second pair of flaps extend from the crotch region upwardly toward an upper waist section of the torso section.

12. The pantyhose undergarment of claim 7 further characterized in that the reinforcing fabric strip has substantially the same width on the rear portion of the torso section as the reinforcing strip on the front portion of the torso section.

13. The pantyhose undergarment of claim 12 further characterized in that the portion of the fabric strip in the crotch region is narrower than on the front portion or rear portion of the torso section.

14. A pantyhose undergarment for men which permits urination and defecation without need of lowering the undergarment, said undergarment comprising:

(a) a fabric torso section adapted to extend about a portion of the torso below the waist, (b) a pair of tubular leg sections extending from the torso section and forming a crotch region on the lower portion of the torso section, (c) a waistband extending around an upper edge of the torso section, (d) a pair of spaced apart vertically disposed folded areas on the front portion of the torso section to create first reinforced areas thereon, (e) a second pair of spaced apart vertically disposed folded areas on the back portion of the torso section to create second reinforced areas thereon, (f) a reinforcing fabric strip extending from the waistband in a front portion of the torso section toward the waistband in the crotch portion of the torso section and which also extends through the crotch region, (g) a first line of stitching securing one of the pairs of spaced apart folded torso sections to the reinforcing fabric strip, said first line of stitching also securing the same spaced apart folded area on the rear portion of the torso section to the torso section and to the reinforcing fabric strip, (h) a second line of stitching securing the other of the pair of spaced apart folded areas on the front portion of the torso section to the torso section and to the reinforcing fabric strip, said second line of stitching also securing the same spaced apart folded area on the rear portion of the torso section to the torso section and to the fabric strip, (i) a first pair of flaps capable of being spread apart to form a first opening in the front portion of the torso section adjacent the crotch region to allow urination without lowering of the undergarment, and (j) a second pair of flaps capable of being spread apart to form a second opening in the rear portion of the torso section adjacent the crotch region to allow defecation without lowering of the undergarment.

15. The pantyhose undergarment of claim 14 further characterized in that said first opening is spaced from said second opening by the fabric strip in the crotch region.

16. The pantyhose undergarment of claim 15 further characterized in that the first pair of flaps extends from the crotch region upwardly toward an upper waist section on a torso section.

17. The pantyhose undergarment of claim 16 further characterized in that the second pair of flaps extends from the crotch region upwardly toward an upper waist section of the torso section.

18. The pantyhose undergarment of claim 17 further characterized in that said openings are generally vertically disposed slits.

19. The pantyhose undergarment of claim 14 further characterized in that the reinforcing fabric strip has substantially the same width on the rear portion of the torso section as the reinforcing strip on the front portion of the torso section.

20. The pantyhose undergarment of claim 19 further characterized in that the portion of the fabric strip in the crotch region is narrower than on the front portion or rear portion of the torso section.

* * * * *

UNITED STATES PATENT AND TRADEMARK OFFICE

CERTIFICATE OF CORRECTION

PATENT NO. : 4,807,304

DATED : February 28, 1989

INVENTOR(S) : Dorothy McCants-Reed et al

It is certified that error appears in the above-identified patent and that said Letters Patent is hereby corrected as shown below:

On the title page, Item (19) "McCants-Reed" should read -- McCants-Reed et al --.

Item (76) Inventor should read

--(76) Inventors: Dorothy McCants-Reed, 13052 Sutton Ave., Cerritos, Calif. 90701, Nancy Ballestero, 7792 Hopi Road, Stanton, Calif. 90680 --.

Signed and Sealed this

Twenty-ninth Day of August, 1989

*Attest:*

DONALD J. QUIGG

*Attesting Officer*

*Commissioner of Patents and Trademarks*